United States Patent [19]

Gysell et al.

[11] 3,934,237

[45] Jan. 20, 1976

[54] ALARM DEVICE

[75] Inventors: Bjorn Gysell, Huddinge; Matz Pehrsson, Linkoping, both of Sweden

[73] Assignee: Bevaknings AB Securitas, Stockholm, Sweden

[22] Filed: Mar. 6, 1974

[21] Appl. No.: 448,579

[30] Foreign Application Priority Data

Mar. 12, 1973 Sweden ..... 7303450

[52] U.S. Cl. ..... 340/213 R; 340/408; 340/409; 340/413

[51] Int. Cl.[2] ..... G08B 26/00

[58] Field of Search.... 340/409, 413, 164 R, 167 R, 340/149 R, 213, 168 SR, 408

[56] References Cited

UNITED STATES PATENTS

| | | | |
|---|---|---|---|
| 3,516,089 | 6/1970 | Cooper | 340/413 |
| 3,686,439 | 8/1972 | Gerard | 340/409 |

FOREIGN PATENTS OR APPLICATIONS

| | | | |
|---|---|---|---|
| 1,235,189 | 2/1967 | Germany | 340/413 |

*Primary Examiner*—Harold I. Pitts

*Attorney, Agent, or Firm*—Sughrue, Rothwell, Mion, Zinn & Macpeak

[57] ABSTRACT

An alarm device comprising a first program mechanism at a monitored station and a second program mechanism at a central monitoring station. The program mechanisms have identical shift registers and identical feedback networks and generate binary signals according to a predetermined arbitrary law. A sensing device is connected to the first program mechanism to cause a departure of the binary signals from the predetermined arbitrary law in the presence of a disturbance. The binary signals from the first program mechanism are compared with the output of the second program mechanism, and an alarm is produced if the outputs are different.

4 Claims, 2 Drawing Figures

ALARM DEVICE

BACKGROUND OF THE INVENTION

1. Field of the Invention

The invention relates to an alarm device, particularly a burglar-alarm device, of the type comprising a first program mechanism at a monitored station and a second program mechanism at a central monitoring station. The program mechanisms are arranged to transmit control signals in accordance with a predetermined signal pattern to a signal comparison circuit at the central monitoring station, which comparison circuit is arranged to generate an alarm signal when the received control signals differ from one another. The first and second program mechanisms have identical electric shift registers with a plurality of binary denominational steps and identical feed-back networks, and each program mechanism is arranged to generate a binary one or zero signal in dependence of the content of the respective shift register, said binary signals constituting discrete control signals.

2. Description of the Prior Art

Alarm devices of this type are difficult to operate, since any disturbance of the equipment at the monitored station causes a difference between the control signals, which results in an alarm being given. One disadvantage inherent with the known devices, is that the signal system is duodirectional, i.e., signals must be transmitted in both directions between the monitored station and the central monitoring station. As a result of this the equipment is both expensive and complicated and requires, inter alia, a duplication of transmitter and receiver, which in turn increases the risk of error and therewith the risk of an alarm being generated. Furthermore, the nature of the signals normally used is such that the signal image becomes distorted during transmission.

SUMMARY OF THE INVENTION

The object of the invention is therefore to provide an alarm device with which the signals are transferred in only one direction and with which a simple signal image is employed which can be positively identified by the receiver, even though the signal should be distorted.

This object is fully realized by means of the invention, according to which a program mechanism in the form of a known shift register provided with a feed-back network is arranged to transmit a random code in the form of a binary digit to the identical program mechanism of the monitoring centre for indexing the shift register thereof and to a comparison circuit, to which the binary output digit is simultaneously applied from the last mentioned program mechanism.

Transmission of the binary digit from the program mechanism of the monitored station is suitably effected in the form of a frequency pulse wherein the binary one is converted to a first frequency $F_1$ and the binary zero is converted to a second frequency $F_2$. These frequency pulses are converted in the receiver at the monitoring centre to the original binary digits.

By selecting a feed-back shift register as the program mechanism it is possible to obtain a practically indefinite member of varying signal programs and the possibility of reproducing this program to couple a signal generator with the correct signal image into the circuit of the monitoring centre is fully eliminated.

Furthermore, by merely using a randomly occurring binary digit, occurring, for example, at determined intervals, the unidirectional signal transfer equipment and the receiver equipment are relatively simple and the risk of signal distortion is substantially eliminated.

BRIEF DESCRIPTION OF THE DROWINGS

The main characterizing features of the invention are disclosed in the accompanying claims and the following description.

FIG. 1 of the accompanying drawing shows a very simplified alarm device according to the invention and FIG. 2 shows a simplified embodiment of a program mechanism.

DESCRIPTION OF THE PREFERRED EMBODIMENT

Figure 1:
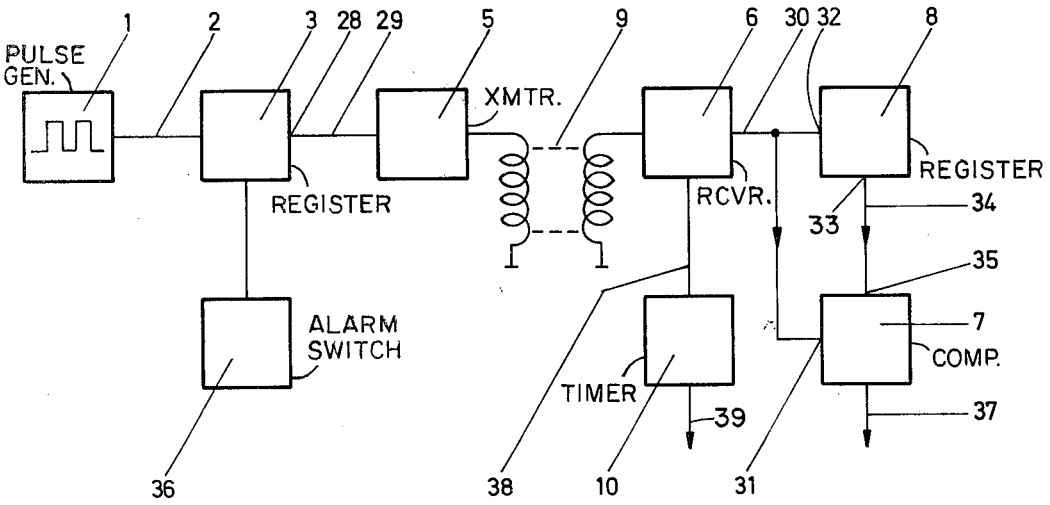
Figure 2:
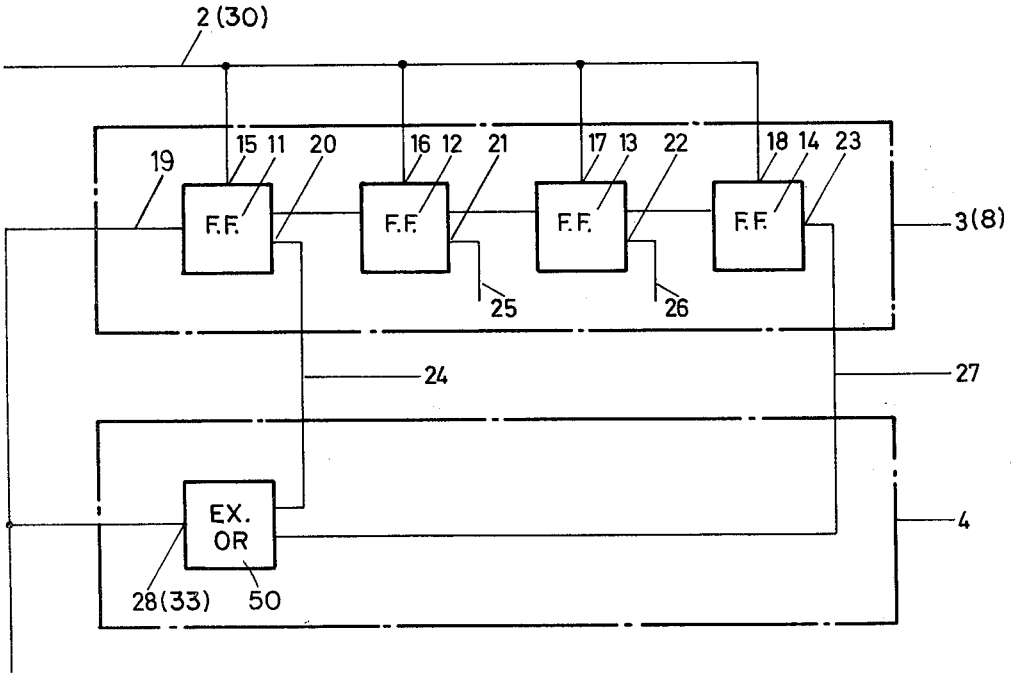

In the embodiment of FIG. 1 a pulse generator 1 is arranged to transmit control pulses or indexing pulses over a line 2 to a program mechanism comprising a feed-back shift register 3. The pulse generator 1 generates, for example, a square wave at a frequency of one indexing pulse/minute. With the illustrated embodiment, the shift register 3, which is shown in FIG. 2, has four denominational units 11, 12, 13 and 14 and four inputs 15, 16, 17 and 18, respectively connected to the output of the pulse generator 1. The information input of the shift register 3 is identified by the reference numeral 19. Each of the denominational units 11, 12, 13, 14 has an information output 20, 21, 22 and 23, respectively. The information outputs are connected over one or more lines 24, 25, 26 and 27, respectively, to a logic network or feed-back network 4. The feed-back network may be passive and comprises, for example, different gate elements, or may be active and includes, for example, a register and gate element. In its simplest form, the logic network 4 comprises a feed-back line connected to only one denominational unit. With the illustrated embodiment, the network 4 comprises an exclusive OR circuit 50 which is connected to the denominational units 11 and 14.

The following truth table shows the output signals from output 28 from the network 4 depending on the content of the denominational units 11, 12, 13, 14 and for successive signals.

Table

| Stored information denominational unit | | | | Signal from output 28 | Indexing signal No. |
|---|---|---|---|---|---|
| 0 | 0 | 0 | 0 | 1 | 0 |
| 1 | 1 | 1 | 1 | 0 | 0 |
| 0 | 1 | 1 | 1 | 1 | 1 |
| 1 | 0 | 1 | 1 | 0 | 2 |
| 0 | 1 | 0 | 1 | 1 | 3 |
| 1 | 0 | 1 | 0 | 1 | 4 |
| 1 | 1 | 0 | 1 | 0 | 5 |
| 0 | 1 | 1 | 0 | 0 | 6 |
| 0 | 0 | 1 | 1 | 1 | 7 |
| 1 | 0 | 0 | 1 | 0 | 8 |
| 0 | 1 | 0 | 0 | 0 | 9 |
| 0 | 0 | 1 | 0 | 0 | 10 |
| 0 | 0 | 0 | 1 | 1 | 11 |
| 1 | 0 | 0 | 0 | 1 | 12 |

The output 28 of the network 4 is connected over a line 29 to a signal transmitter 5 arranged to generate a discrete signal having a first frequency $f_1$ and a duration of, for example, one minute in dependence on the received binary singal 1, and to generate a discrete signal having a second frequency $f_2$ and a duration of, for example 1 minute in response to the received binary signal 0. The signals $f_1$ and $f_2$ respectively, are transmitted from the monitored station over a line 9 to the monitoring central, where the frequency signals are converted in receiver 6 to a binary 1 or 0 corresponding to the binary signal transmitted from the output 28. Instead of transmitting a frequency signal, another analogue signal, for example a voltage signal, can be transmitted.

The binary signal transmitted from the receiver 6 over the line 30 is received on one input 31 of a comparison circuit 7 and on the indexing input 32 of a feed-back shift register 8, which is identical with the register 3. It should be noted that the leading edge or the trailing edge of the pulse to register 8 could be used for stepping the register. Should the trailing edge of the pulse be used the register will be prepared to handle information and thereafter stepped. Should the leading edge be used this means that the register will be stepped and thereafter the comparison will be carried out. Thus, the content of the shift register or program mechanism 8 is adjusted in correspondence with the content of the shift register 3 and there is generated on the output 33 a binary one or zero, respectively, i.e., the same output signal as that generated on the output 28 and on the line 30. The binary output digit from the program mechanism 8 is fed over line 34 to the second input 35 of the comparison circuit 7, which in the illustrated case establishes full agreement between the program mechanism 3 and the program mechanism 8.

Connected to the program mechanism 3 of the monitored station or to some other circuit capable of activating the signal system are alarm switches 36 which, upon unauthorized entry into the monitored premises, so activate the program mechanism that the output signal therefrom differs from, for example, the pattern shown in the table. This distortion of the signal pattern causes lack of agreement between the compared signals and an alarm is transmitted over the line 37.

To prevent the monitoring system from being rendered inoperative, by cutting the line 9, there is provided at the monitoring central a timing mechanism 10 which is set to zero via a line 38 from the receiver 6 each time a signal is received. If the timing mechanism fails to receive such a signal for a specific period of time, determined by the indexing pulse frequency, the timing mechanism 10 will transmit an alarm signal over the line 39.

The invention can be modified in a number of ways within the scope of the claims, and thus the generator 1 can be omitted and the program mechanism 3 can be made self-indexing. Further, the alarm device includes means, not shown, for restoring the two program mechanisms to a mutually identical starting position subsequent to being de-synchronized.

We claim:

1. An alarm device comprising a first program mechanism at a monitored station and a second program mechanism at a central monitoring station, which program mechanisms are arranged to transmit control signals in accordance with a predetermined signal pattern to a signal comparison circuit arranged to generate an alarm signal when the received control signals differ from one another, the first and the second program mechamisms being provided with identical electric shift registers with a plurality of binary denominational steps and identically connected feed-back networks, each program mechanism being arranged to generate a binary one or zero signal in dependence on the content of the respective shift register, said binary signals constituting discrete control signals, the control signal from the first program mechanism being coupled to a transmitter at said monitored station arranged to transmit an analogous signal to a receiver at the central monitoring station, which receiver converts the analogous signal to an output signal identical with the original binary control signal, which output signal is coupled to the second program mechanism to step the shift register thereof to generate a control signal, which together with the output signal of the receiver, is coupled to the signal comparison circuit, and wherein a timing mechanism is arranged to generate an alarm signal in the absence of an output signal from the receiver after a predetermined period of time.

2. An alarm system, comprising:

first program means at a monitored station adapted to generate binary signals in accordance with a predetermined arbitrary law;

sensing means connected to said first program means to cause a departure of said binary signals from said predetermined arbitrary law in the presence of a disturbance;

transmitter means at said monitored station for transmitting said binary signals to a monitoring station;

receiver means at said monitoring station for receiving said binary signals;

second program means connected to said receiver means and clocked by said received binary signals to generate the same binary signals as those generated by said first program means in accordance with said predetermined arbitrary law, said first and second program means being of identical construction comprising a shift register and a feedback network connected thereto;

comparator means for comparing said received binary signals with the output of said second program means; and alarm means controlled by said comparator means for actuation upon detection of a difference between said received binary signals and the output of said second program means.

3. The system of claim 2 further comprising another alarm means connected to said receiver means to generate an alarm signal in the absence of said received signals for a predetermined time period.

4. The system of claim 2 wherein each feedback network comprises an exclusive-OR circuit having two inputs connected to the first and last stages of said shift register.

* * * * *